US007741628B2

(12) United States Patent
Stengrimsen

(10) Patent No.: US 7,741,628 B2
(45) **Date of Patent: *Jun. 22, 2010**

(54) CONTAINER FOR LONG-TERM STORAGE OF RADIOACTIVE MATERIAL, AND METHOD AND APPARATUS FOR MANUFACTURING THE CONTAINER

(75) Inventor: Frank Stengrimsen, Lørenskog (NO)

(73) Assignee: Nuclear Protection Products AS, Ilseng (NO)

( * ) Notice: Subject to any disclaimer, the term of this patent is extended or adjusted under 35 U.S.C. 154(b) by 379 days.

This patent is subject to a terminal disclaimer.

(21) Appl. No.: 10/577,609

(22) PCT Filed: Oct. 19, 2005

(86) PCT No.: PCT/NO2005/000393

§ 371 (c)(1),
(2), (4) Date: Apr. 27, 2006

(87) PCT Pub. No.: WO2006/043826

PCT Pub. Date: Apr. 27, 2006

(65) Prior Publication Data

US 2008/0277602 A1 Nov. 13, 2008

(30) Foreign Application Priority Data

Oct. 19, 2004 (NO) ..... 20044434

(51) Int. Cl.
*G21F 5/00* (2006.01)

(52) U.S. Cl. ..... 250/507.1; 250/505.1; 250/506.1; 250/515.1

(58) Field of Classification Search ..... 250/505.1, 250/506.1, 507.1, 515.1, 517.1; 264/645, 264/603, 513, 512, 510, 500, 537, 297.2, 264/297.1, 328.1
See application file for complete search history.

(56) References Cited

U.S. PATENT DOCUMENTS 3,466,662 A 9/1969 Blum (Continued)

FOREIGN PATENT DOCUMENTS

WO WO 01/57880 8/2001

*Primary Examiner*—Jack I Berman
*Assistant Examiner*—Hanway Chang
(74) *Attorney, Agent, or Firm*—Rodman & Rodman

(57) ABSTRACT

A long-term storage container (1) for storage of radioactive material to inhibit radioactive radiation therefrom to the outside of the container, the top of said container to be closed by a screw-on radioactive radiation inhibiting lid (7), said container having an integral inner container part (2; 34; 62; 62') of a first material, e.g. plastic material, an integral outer container part (3; 43; 69) of a second material, e.g. plastic material, and radioactive radiation inhibiting material (4; 38; 68) in an inter-space between the walls and bottoms of said inner and outer container parts. To fill the inter-space an inter-space container part (4; 38; 68) is integrally moulded through injection or pressure moulding and then fitted onto the inner container part (2; 34; 62; 62') to subsequently mould the outer container part (3; 43; 69) onto the outside of the inter-space container part (4; 38; 68). A specially made container lid (7) is provided. A preferred twin-mould moulding apparatus (61) provides for simultaneous pre-casting of the inner container part (62') and the outer container part (69) in a respective mould of the apparatus.

18 Claims, 10 Drawing Sheets

U.S. PATENT DOCUMENTS 4,569,818 A 2/1986 Popp et al.
6,166,390 A 12/2000 Quapp et al.
6,639,236 B1 * 10/2003 Low et al. ..... 250/506.1
7,354,544 B1 * 4/2008 Stengrimsen ..... 264/250
7,425,195 B2 * 9/2008 Wissman et al. ..... 600/7

* cited by examiner

Fig.5a
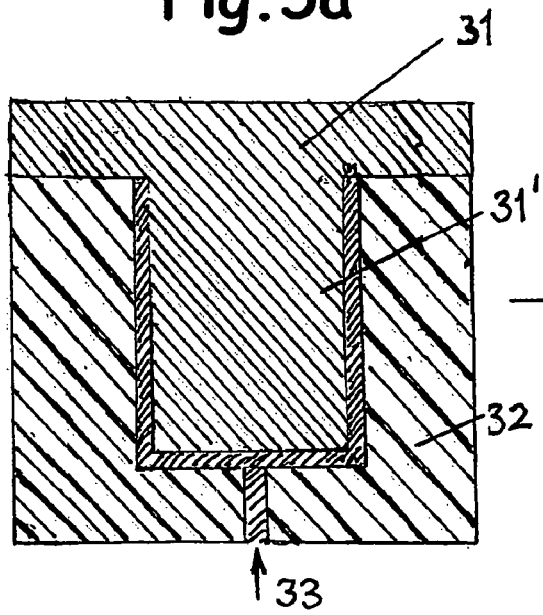
Fig.5c
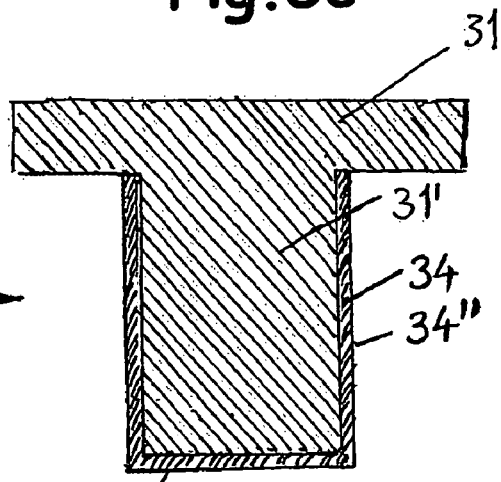
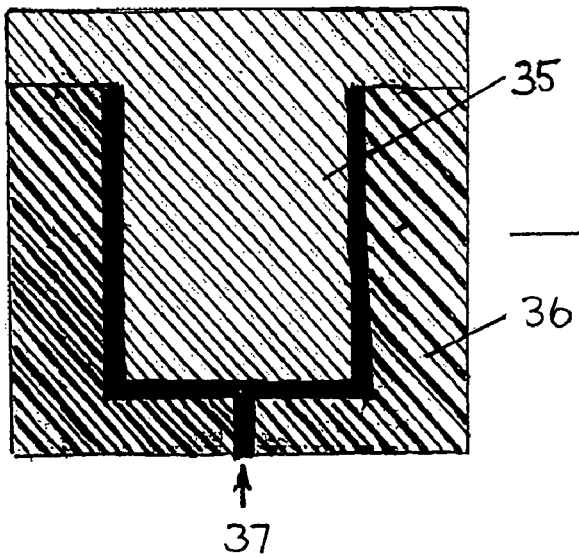
Fig.5b
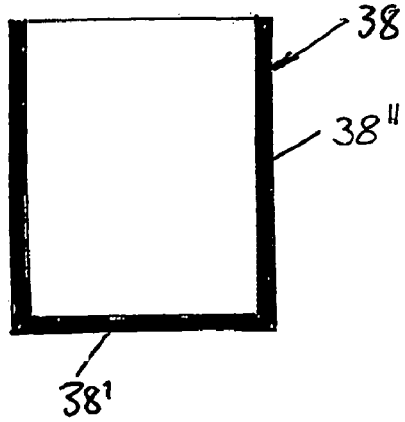
Fig.5d

Fig.5e
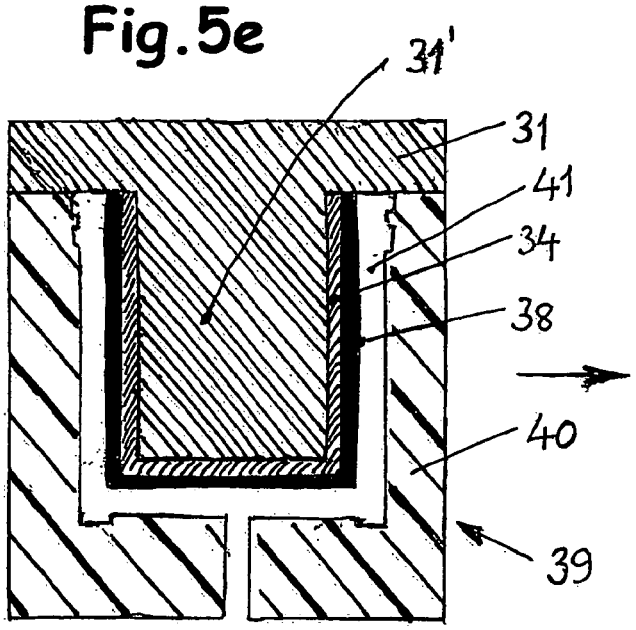
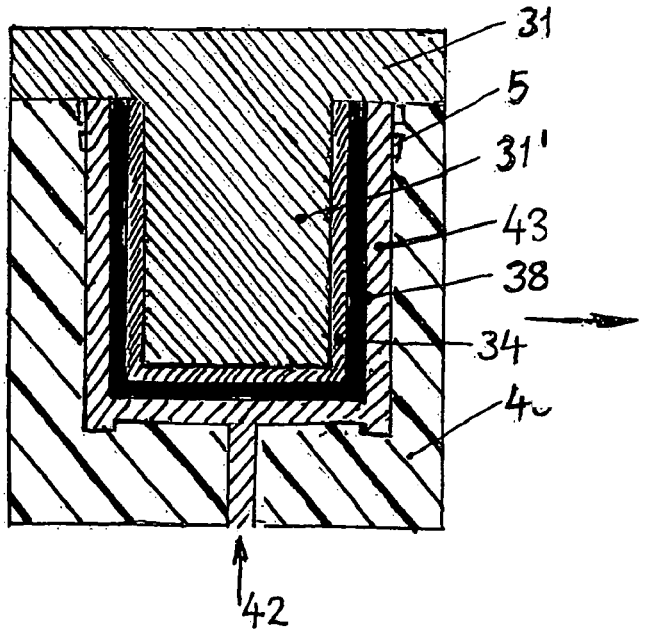
Fig.5f
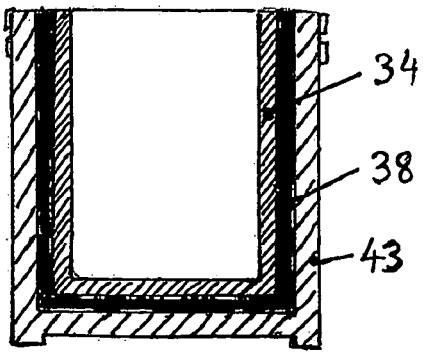
Fig.5g

CONTAINER FOR LONG-TERM STORAGE OF RADIOACTIVE MATERIAL, AND METHOD AND APPARATUS FOR MANUFACTURING THE CONTAINER

The present invention relates to a method for manufacturing a long-term storage container for storage of radioactive material to inhibit radioactive radiation therefrom to the outside of the container, said container having a bottom and upright wall extending therefrom, the top of said container to be closed by a screw-on lid, said container having an integral inner container part of a first material, e.g. plastic material, with a bottom and upright wall, an integral outer container of a second material, e.g. plastic material with a bottom and upright wall, and radioactive radiation inhibiting material in an inter-space between the walls and bottoms of said inner and outer containers. The invention also relates to a long-term storage container for storage of radioactive material to inhibit radioactive radiation therefrom to the outside of the container.

Further the invention relates to a method for manufacturing a radioactive radiation inhibiting lid suitable for fitting onto a top region of a long-term storage container for storage of radioactive material and inhibiting radioactive radiation therefrom to the outside of the lid. Also, the invention relates to a lid for use with such long-term storage container.

Finally, the invention also relates to a moulding apparatus for manufacturing the storage container.

Long-term storage of radioactive material in a safe manner is an ever increasing environmental problem. Attempts have been made to have such material stored in metal barrels, but these are subject to rust or corrosion and therefore prone to leakage of the radioactive material.

To overcome such deterioration and possible leakage problems, there has been proposed to provide long-term storage containers of the type mentioned in the introductory part. Such container was essentially attempted to be made by inserting space members between the inner and outer container parts, and thereafter filling in liquid form the inter-space with In recognition of such defective manufacturing method, and also the urgent need for safer, long-term storage containers which are ready to use after manufacturing without necessity of subsequent radioactive radiation leakage tests, the present invention provides for a method and container having properties of an inter-space container part made from a void free radioactive radiation inhibiting material, and being safe and simple to manufacture, thus providing a safe, reliable storage container not requiring subsequent reliability tests.

In accordance with the invention the manufacturing method of such container is characterised by the features as stated in the relevant independent method claims and further features thereof are stated in their respective sub-claims.

Suitably, the inner and outer container parts are made from a plastic material such as e.g. high density polyethylene, and the inter-space container part between the inner and outer container parts is moulded from a radioactive radiation inhibiting material which is selectable from one of: lead, lead alloy, tin and tin alloy.

According to the invention the method for manufacturing the radioactive radiation inhibiting lid comprises the features as stated in the relevant independent method claims. Further embodiments thereof are stated in the related sub-claims.

Characteristic features of the storage container are defined in the in the independent article claim and further features thereof are defined in its sub-claim.

Characteristic features of the lid for use with the container are defined in the relevant independent claim and further features thereof are defined in its sub-claims.

The inventive method preferably makes use of a moulding apparatus for manufacturing the storage container, as defined in the introductory part, as the characteristic features of the apparatus appear from the relevant independent claim. A further feature of the apparatus appears from its sub-claim.

It is important in a safe manner to be able to lift the storage container with its contents, and according to an embodiment of the lid there is at a lower end of the lid skirt provided a lifting or engagement face suitable to co-operate with a container lifting device when such device is made to engage a container having a fitted lid.

As soon as a storage container has been fully filled by radioactive substances and other material, it is important to be able to safeguard against the lid when fully screwed onto the storage container being removable from the container. Therefore, the step of casting said lid threads includes providing a locking member for non-releasable engagement with locking means on the outside of the storage container when the lid is fully screwed onto the container.

Suitably, said plastic material in the lid is high density polyethylene, and said radioactive radiation inhibiting material is selected from lead, lead alloy, tin and tin alloy.

The storage container thus comprises an integral inner container part of plastic material with a bottom and upright wall, an integral outer container part of plastic material with a bottom and upright wall, and a radioactive radiation inhibiting material in an inter-space between the walls and bottoms of said inner and outer storage container part, respectively. According to the invention, the radioactive radiation inhibiting material is in the form of an injection or pressure moulded, integral inter-space container having a bottom and an upright wall extending therefrom. In a preferred version the outer container part is thus a storage container part moulded onto the outside of the inter-space container when the inter-space container is fitted onto the outside of the inner container.

The storage container has on an outside face of the outer container part threads configured to engage threads on said lid, and the outer container part has locking means for non-releasable locking engagement with a locking member on said lid when said lid is fully screwed onto the storage container.

The invention is now to be further described with reference to the attached drawing figures which illustrate non-limitative embodiments of the various aspects of the invention.

FIG. 1 shows in vertical section and perspective view a typical storage container, according to the invention.

FIG. 2*a* shows schematically in cross-section a storage container according to the invention with a fitted lid, and FIG. 2*b* is a slight modification of the container.

FIG. 5 is a simplified illustration of major steps of a preferred embodiment for manufacturing the storage container.

Figure 6A:
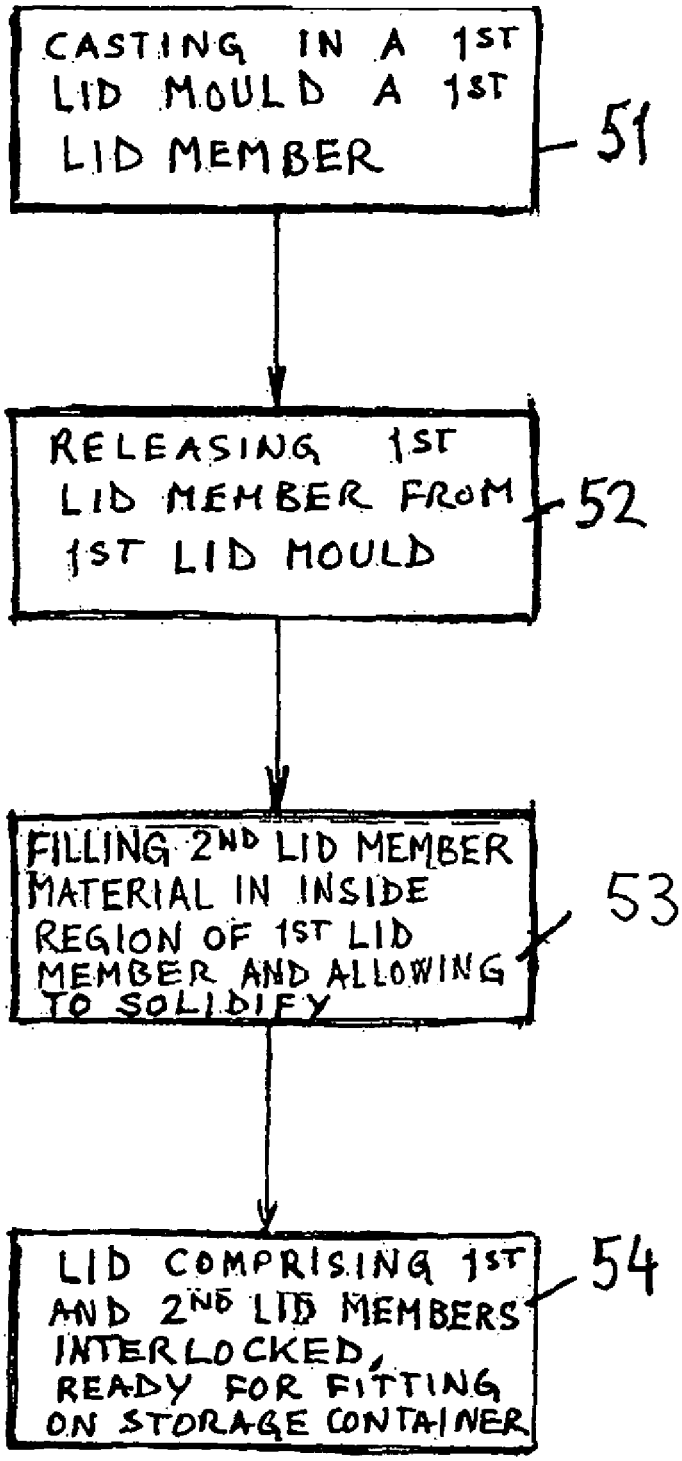
Figure 6B:
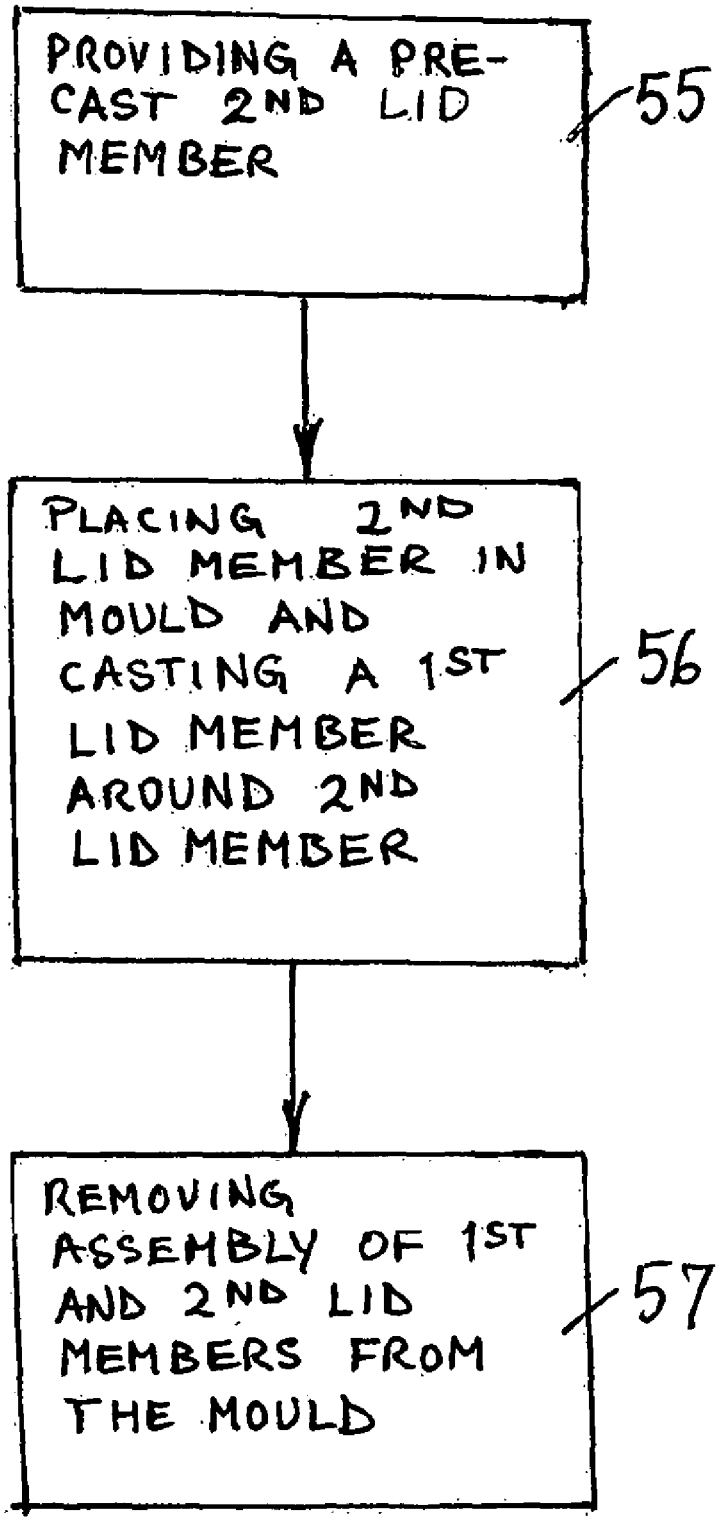

FIG. 6*a* is a simplified flow diagram illustrating major steps in a method for manufacturing the lid to be used with the storage container, and FIG. 6*b* is a simplified flow diagram illustrating major steps in an alternative method for manufacturing the lid to be used with the storage container.

Figure 4:
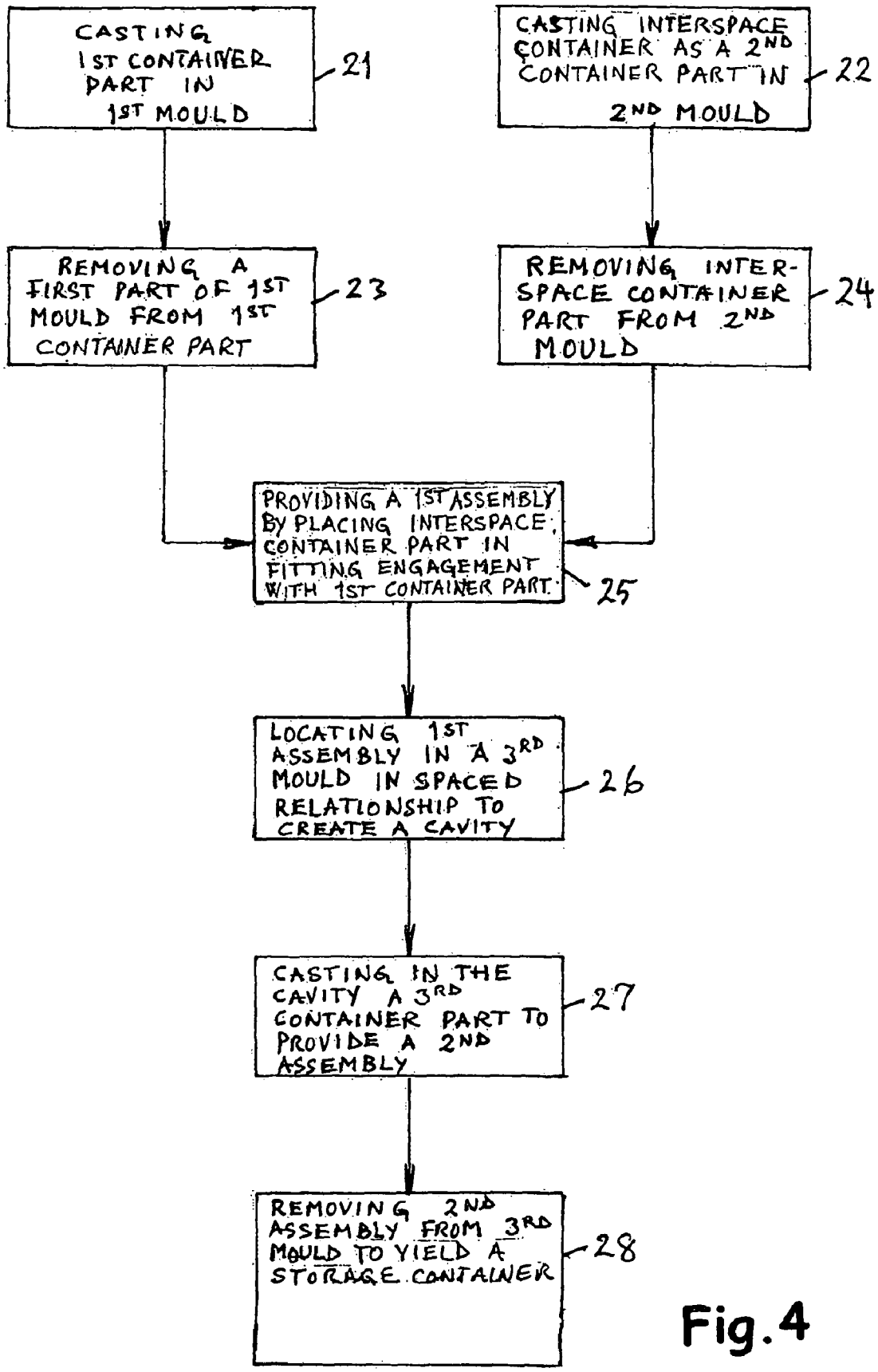
FIG. 4 is a simplified flow diagram illustrating major steps in the method for manufacturing the storage container.

FIGS. 7*a*-7*d* illustrate in more detail practical aspects of steps used in manufacturing the storage container as depicted in FIGS. 4 and 5.

Figure 1:
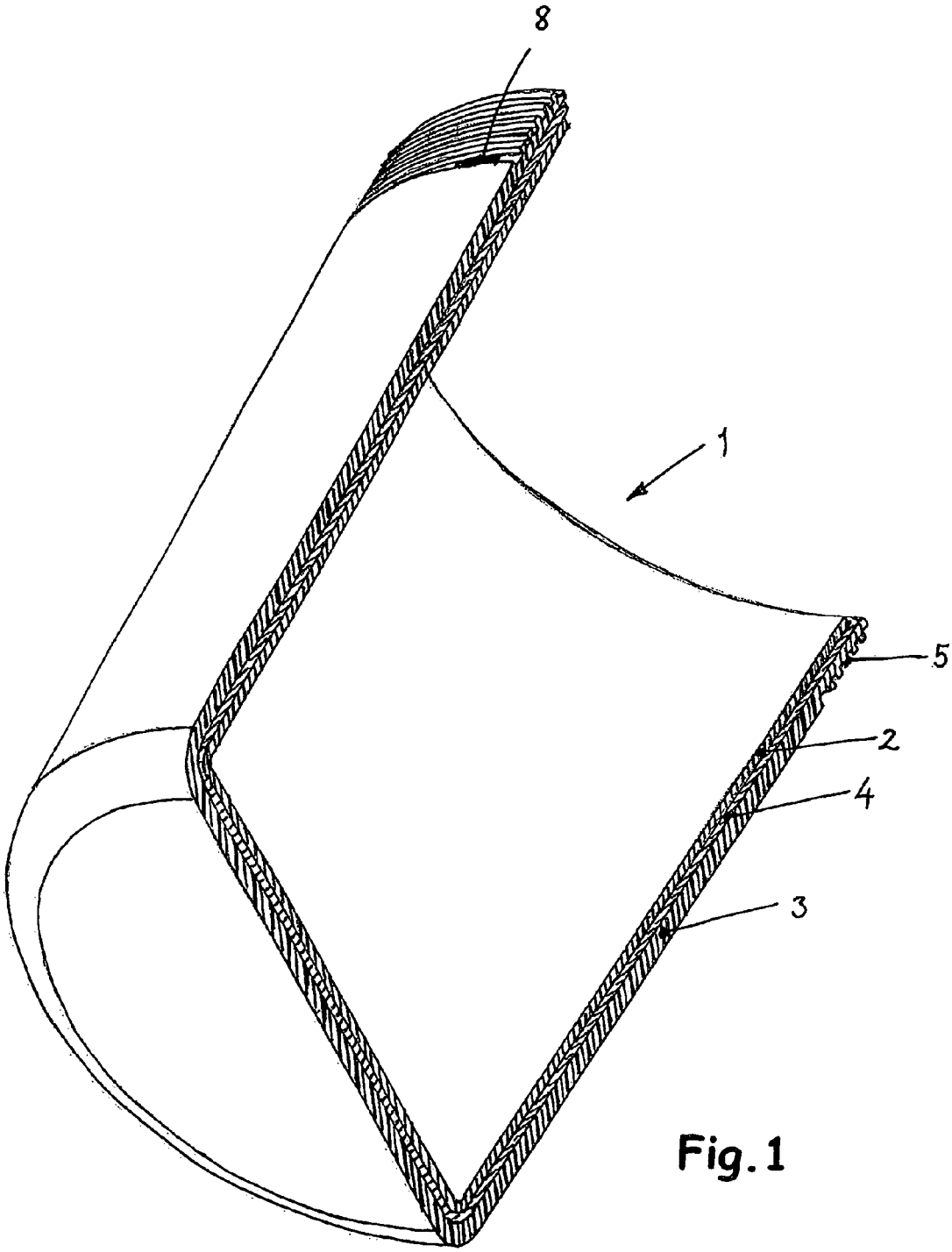

FIG. 1 shows in vertical section and perspective view a half of storage container 1 according to the invention, having an inner container part 2, an outer container part 3, and an inter-space container part 4.

It is noted that the inner container part 2 has integral bottom and upright wall. Also, the outer container part 3 has integral bottom and upright wall. An inter-space between the inner container part 2 and the outer container part 3 is defined by an inter-space container part 4 having a bottom and upright wall integrally made from a radioactive radiation inhibiting material through injection moulding or pressure moulding.

The inner and outer container part 2, 3 are suitably made from a plastic material, e.g. high density polyethylene, through injection moulding, and the radioactive radiation inhibiting material is suitably one of: lead, lead alloy, tin and tin alloy.

Figure 2A:
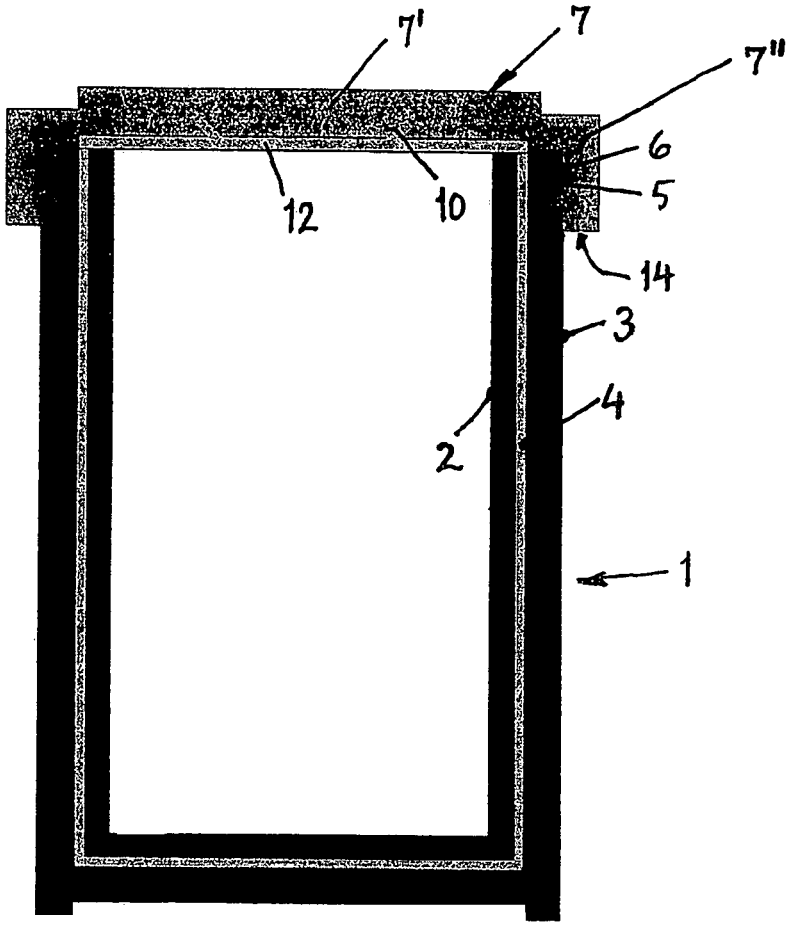
Figure 3:
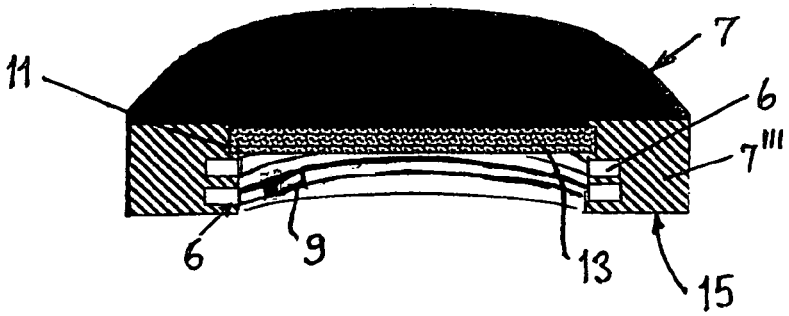
FIG. 3 shows a variant of the lid indicated in FIG. 2.

As shown on FIGS. 2*a* and 3 there is at an upper, outside region of the outer container part 3 is provided threads 5 configured to engage threads 6 on a lid 7, and wherein the outer container part has locking means 8 for non-releasable locking engagement with a locking member 9 on said lid when said lid is fully screwed onto the storage container. Said locking means and locking member are merely indicated without illustrating any details. However, it will be visualized that a resilient member and a hook-like member could provide such locking, i.e. a sort of snap function.

The lid 7 has an injection moulded, integral first lid member 7', 7"; 7'" of plastic material in the form of a top part 7' and a skirt 7" depending therefrom, an inside of said skirt 7" having said threads 6 to enable fitting engagement with the external threads 5 on the storage container. There is in addition at least one recess 10; 11 in said top part, and a second lid member 12; 13 is provided in the form of a solidified radioactive radiation inhibiting material located in an inside region of said first lid member and said at least one recess, said material retained in said at least one recess 10; 11 providing for non-releasable locking of the second lid member 12; 13 to the first lid member 7', 7"; 7'".

A bottom end 14; 15 portion of the skirt portion of said first lid member 7', 7"; 7'" configured to be able to engage a container lifting device (not shown). Similarly to the storage container parts 2 and 3, the first lid member 7', 7"; 7'" is suitably made of a plastic material, e.g. high density polyethylene. The manufacturing of the first lid member is suitably through an injection moulding process. The radioactive radiation inhibiting material is suitably one of lead, lead alloy, tin and tin alloy.

Figure 2B:
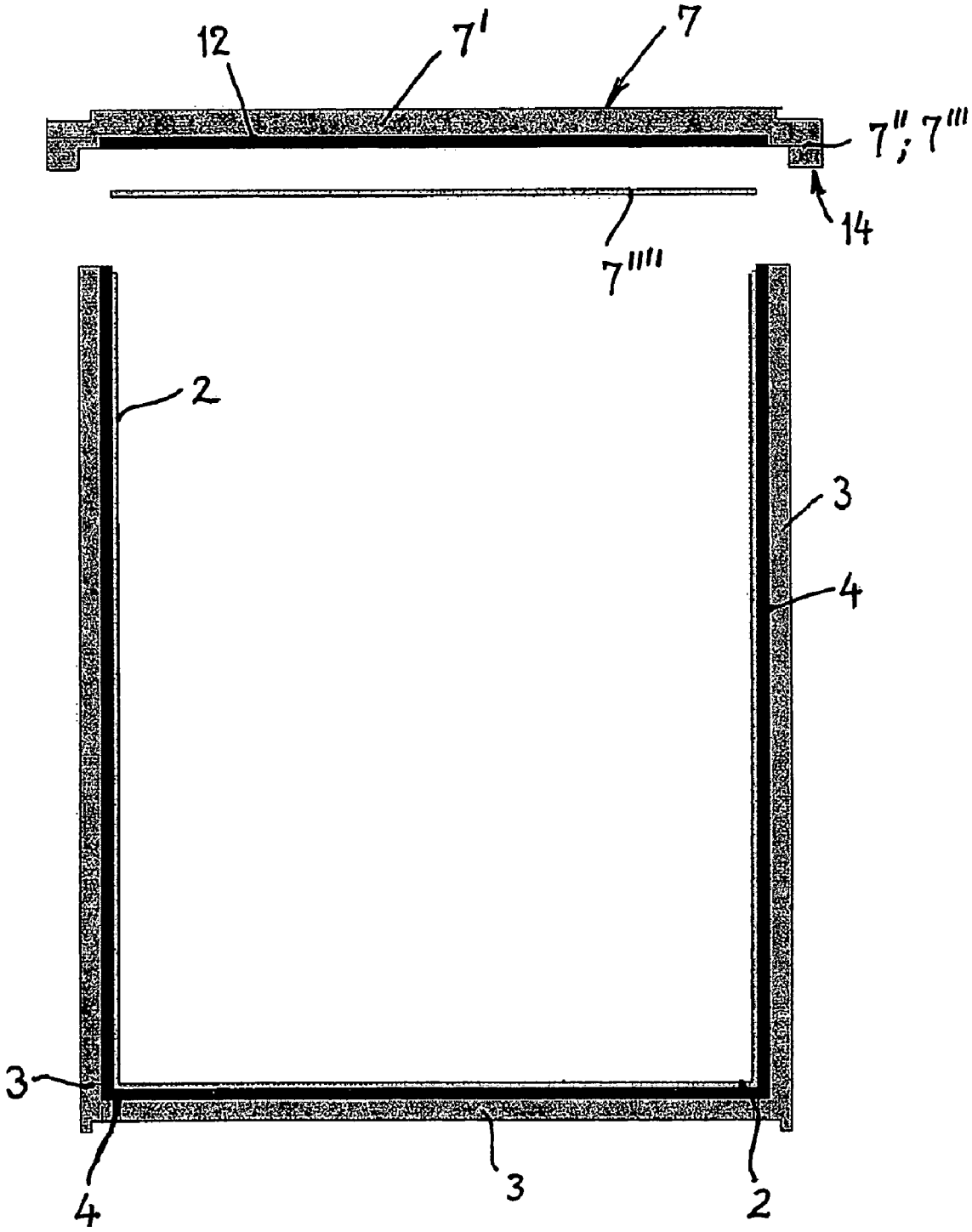

From FIG. 2*b* it will be noted that the lid is provided with an inner liner 7"". It will be appreciated that such inner liner is suitably be applied to the embodiments of FIGS. 2*a* and 3 through post-installing the liner after providing the assembly of the two lid parts. Such post-installing can e.g. be made through use of snap-engagement of the liner with the lid assembly or by letting the liner simply rest on an upper edge portion of the inner container.

It may also be considered to have inside the inner container an internal lid to be placed on top of the radioactive material located inside the inner container.

FIG. 4 shows the major steps of the method for manufacturing the long-term storage container for storage of radioactive material to inhibit radioactive radiation therefrom, as disclosed in connection with FIGS. 1, 2 and 3. The method comprises:

in step 21 integrally casting in a first mould 31, 31', 32 (FIG. 5*a*) through injection moulding via an inlet 33 (FIG. 5*a*) a first container part 34 (FIG. 5*a*) having a bottom 34' and a wall 34";

in step 22 integrally casting in a second mould 35, 36 (FIG. 5*b*) through injection or pressure moulding via an inlet 37 (FIG. 5*b*) an inter-space container part 38 of said radioactive radiation inhibiting material, said inter-space container part 38 having a bottom and a wall and forming a second container part;

in step 23 (FIG. 5*c*) removing a first part 32 (FIG. 5*a*) of the first mould 31, 31', 32 (FIG. 5*a*) which formed a first side wall face 34' (FIG. 5*a*) and a first bottom face 34" (FIG. 5*a*) of the first integral container part 34 (FIG. 5*c*);

in step 24 (FIG. 5*d*) removing said inter-space container part 38 from the second mould 35, 36, in step 25 (FIGS. 5*c* and 5*d* combined) placing said inter-space container part 38 in fitting engagement with said first wall face 34' (FIG. 5*a*) and said first bottom face 34" (FIG. 5*a*) of the first container part 34 (FIG. 5*c*) to form a first assembly of container parts 34, 38, and with the first container part in engagement with a portion 31' of a second part 31, 31' of the first mould;

in step 26 (FIG. 5*e*) locating in a third mould 39 (FIG. 5*c*); 52, 53 (FIG. 6*c*) the first assembly of container parts 34, 38 (FIG. 5*e*) with said inter-space container part 38 in spaced relationship to a mould member 40 (FIG. 5*c*) of the third mould 39, so as to form a cavity 41 between the member 40 and the inter-space container part 38, the second part 31, 31' of the first mould having a portion 31' inside the first container part 34 to support it during moulding of the third container part, and a top 31 of the second part of the first mould closing off an open end of said third mould member 40;

in step 27 (FIG. 5*f*) through injection moulding via inlet 42 into said cavity 41 integrally casting a third container part 43 (FIG. 5*f*) having a side wall and a bottom; and in step 28 (FIG. 5*g*) releasing a second assembly of container parts formed by the first, second and third container parts 34, 38, 43 (FIG. 5*g*) from the said third mould 39 (FIG. 5*c*), however noting that also the mould member 31, 31' is removed.

It is observed that in FIG. 5 the first container part 34 is said inner container part, and that the inter-space container part 38 forms the second container part and fits onto the outside of the container part 34.

Suitably in the injection moulding process of the inner and outer container parts there is used a plastic material which is e.g. high density polyethylene.

The inter-space container part 38 forming the second container part is moulded from a radioactive radiation inhibiting material selectable from one of: lead, lead alloy, tin and tin alloy.

Following the procedure according to FIG. 5, step 27 (FIG. 5*f*) in addition provides for threads 5 on the outside of said outer container part, said threads dimensioned to enable fitting engagement with threads on a lid to be fitted by screwing onto the storage container.

Further, the provision of threads on the outer container part also includes provision of locking means configured for non-releasable engagement with a locking member on said lid when said lid is fully screwed onto the container.

With reference to FIG. 6*a* the method for manufacturing the radioactive radiation inhibiting lid which is suitable for fitting onto a top region of a storage container for long term storage of radioactive material and inhibiting radioactive radiation therefrom, comprises:

in step 51 casting in a first mould through injection moulding of a plastic material, e.g. high density polyethylene, an integral first lid member with a top part 7' and a skirt 7"; 7'" depending therefrom, said casting providing on an inside of said skirt threads 6 to enable fitting engagement with external threads 5 on said storage container 1, said casting further providing in said top part at least one recess 10; 11, in step 52 releasing from the first mould said first lid member 7', 7"; 7''' in step 53 filling in liquid form a radioactive radiation inhibiting material in an inside region of said first lid member and said at least one recess, and in step 54 allowing said radioactive radiation inhibiting material, suitably selected from lead, lead alloy, tin and tin alloy, to solidify to form the second lid member 12; 13, material retained in said at least one recess 10; 11 non-releasable locking the second lid member to the first lid member.

The first mould is configured to provide at a lower end 14; 15 of the skirt a lifting or engagement face suitable to cooperate with a container lifting device (not shown) when such device is made to engage a container having a fitted lid.

Step 51 also includes in casting said threads 6 provision of a locking member 9 for non-releasable engagement with locking means 8 on the outside of the storage container when the lid is fully screwed onto the container.

As an alternative to the method depicted in FIG. 6*a*, the following steps could be made as depicted on FIG. 6*b*, viz.:

in step 55 providing a pre-cast second lid member 12 made from radioactive radiation inhibiting material, suitably selected from lead, lead alloy, tin and tin alloy, in step 56 placing the second lid member in a mould for moulding around at least one face and the edges thereof a first and integral lid member through injection moulding of a plastic material, e.g. high density polyethylene, said integral first lid member provided with a top part 7' and a skirt 7"; 7''' depending therefrom, said casting providing on an inside of said skirt threads 6 to enable fitting engagement with external threads 5 on said storage container 1, said second lid member 7 further providing in said top part at least one recess 10; 11 in which said second lid member 12 is located, and in step 57 releasing from the first mould said first lid member 7', 7"; 7''' with the second lid member 12 in non-releasable engagement the first lid member.

FIGS. 7*a*-7*d* show in more detail practical aspects of the manufacturing steps in accordance with the invention.

Figure 7A:
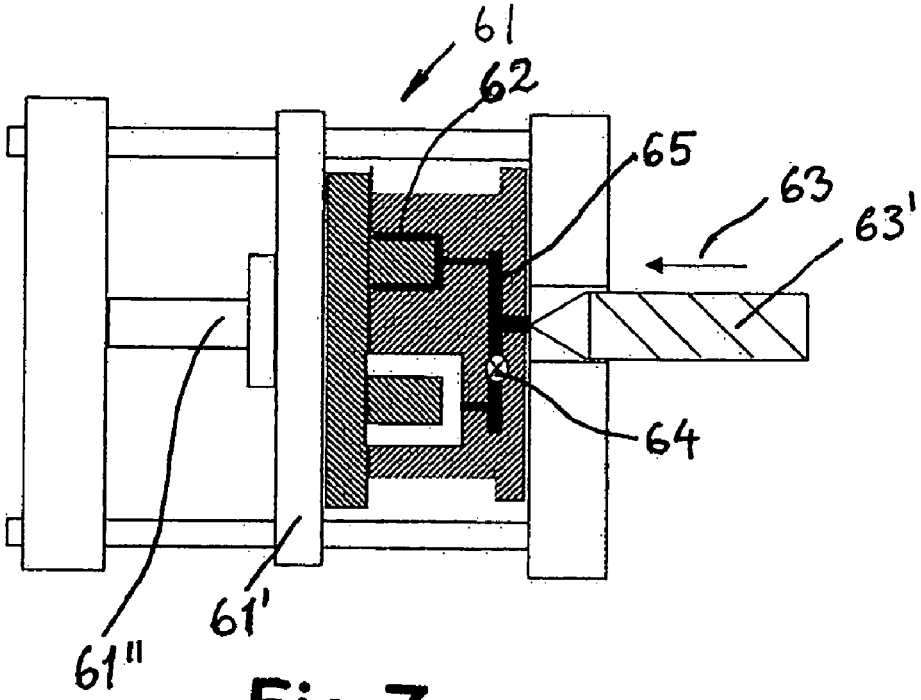

FIG. 7*a* shows the moulding apparatus 61 closed and ready for moulding the inner container part 62 through injection moulding 63 via e.g. a screw conveyor 63'. The hot flow of plastic material to the cavity dedicated to casting of the outer container part has been shut off by a valve 64 located in a hot channel system 65.

Figure 7B:
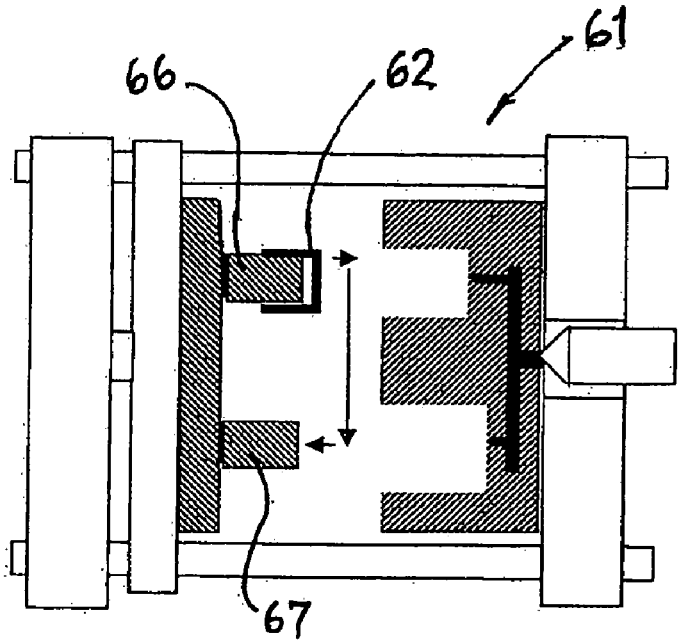

FIG. 7*b* shows the inner container part 62 after having being cast, the moulding apparatus 61 has been opened and the inner container part 62 is ready to be removed from one mould core 66 to another mould core 67 of the apparatus, the mould core 67 being located in the part of the apparatus intended for casting the outer container part. Thus, FIG. 7*b* also illustrates removal of the inner container part 62 from the mould core 66 to the core 67, and such movement is suitably made by means of a robot (not shown). The cores 66, 67 are suitably located on an apparatus slide 61' and movable by a powered extendable and retractable device, e.g. a hydraulic or pneumatic cylinder and piston device.

Figure 7C:
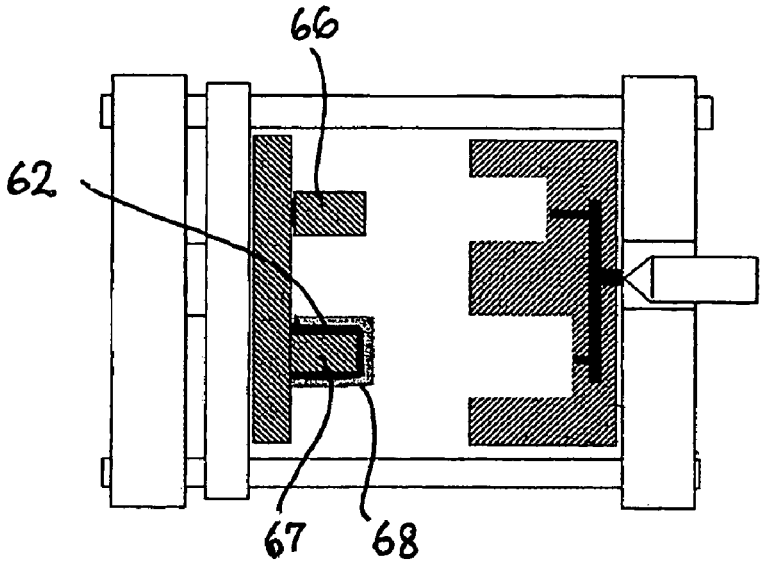

FIG. 7*c* shows the inner container part 62 located on the core 67 and with the separately made inter-space container part 68 of radioactive radiation inhibiting material fitted onto the outside of the inner container part 62. The container part 68 is suitably moved and positioned into engagement with the container part 62 through use of a dedicated robot (not shown).

The inter-space container part 68 which is to inhibit radioactive radiation from spreading from the inside of the storage container to the environment outside the container is suitably made from a radioactive radiation inhibiting material, such as e.g. lead, lead alloy, tin or tin alloy, to form to the extent possible a nuclear radiation barrier. The inter-space container part should be of a unitary structure in order to avoid any leaks therethrough of any highly radioactive material to be retained by the container. The inter-space container part has to be cast in a separate mould, in connection with the disclosure of FIGS. 4 and 5 denoted as the second mould. In one aspect of its manufacturing process, the inter-space container 68 could be made or cast at the same manufacturing plant as the inner and outer container parts are injection moulded, but in a separate moulding apparatus located thereat. However, in another aspect the inter-space container could be made by a different manufacturer and delivered as just-in-time (JIT) delivery at the location where the injection moulding of the inner and outer container parts of plastic material takes place.

Figure 7D:
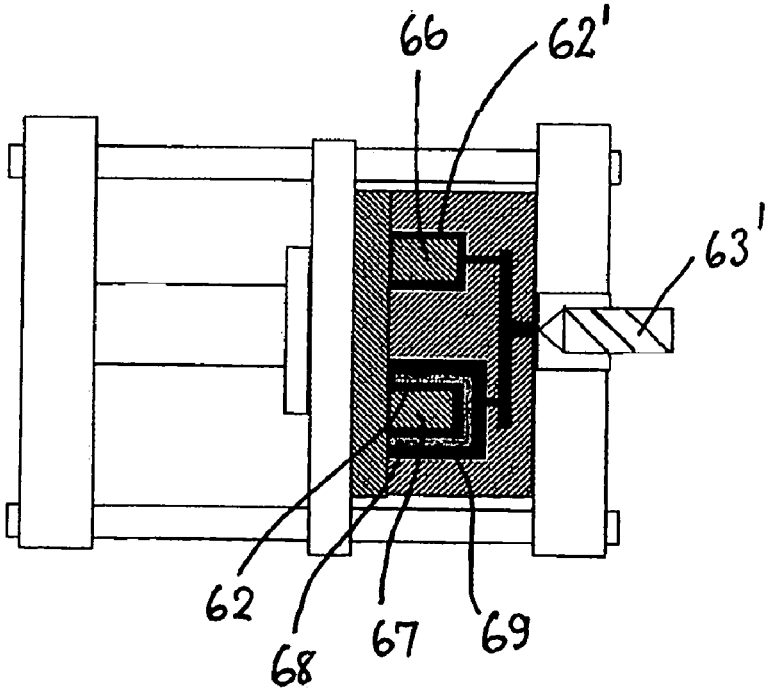

As indicated on FIG. 7*d* supply 63' of hot injection material is enabled, and when the mould is in closed position as indicated, the outer container part 69 is moulded at the same time as a further inner container part 62' is moulded. After completed cooling-down-time, the moulding apparatus 61 then opens and the complete storage container having inner 62, inter-space 68 and outer 69 container parts is removed from the moulding apparatus 61. Further, the inner container part 62' is moved from the core 66 to the core 67 as depicted on FIG. 7*b*, and the cycle just described for making the complete container 62, 68, 69 and a further inner container part 62' is repeated.

It will be recognized that in the context of FIG. 4 and with reference to FIG. 7, the first mould is to be construed as that enabling the casting of the inner container part, i.e. the cavity where the core 66 is located. Likewise, the third mould is to be construed as that enabling the outer container part 69 to be cast, i.e. in the cavity where the core 67 is located and where the inner container part 62 and the inter-space container part 68 are supported by the core 67. The second mould is in this context and with reference to FIG. 4 a mould used for casting the inter-space container part, whether at the plant nearby the first and third mould or at some remote place.

The container 62, 68, 69 is suitably made as a circular container having a volume of e.g. 200 litres, although larger or smaller volume contents are conceivable without departing from the concept of the invention. As indicated earlier, the lid and its inner liner are made separately. The container comprises the inner container part and the outer container part made from a plastic material, suitably polyethylene such as e.g. PEH (HDPE), although other plastic materials may be suitable.

An important aspect of the making of the inter-space container part 68 as a separate is that it will be possible to inspect it properly before it is fitted into the moulding apparatus as shown on FIG. 7*c*. The same of course to the approach indicated on FIG. 5, and FIGS. 5*b* and 5*d* in particular. As the inter-space container part is crucial to inhibit unwanted radioactive radiation from radioactive material to be stored in the container, a visual inspection and also measurement based detection of any damages or production flaws will be important to establish prior to the fitting of this container part 68 on the inner container part 62 and the subsequent casting of the outer container part 69.

The invention provides for a better engagement between the container parts, more easily made container parts and assembly thereof, and highly improved safeguard against unintended leakage of radioactive radiation from the inside to the outside of the container. Further, the invention provides for a more permanent storage of the radioactive material, thereby avoiding having to change storage containers at a later stage. The invention provides for a storage container which has a storage capacity substantially larger than that of any currently available storage container for known types of nuclear medium and high radioactive material. The invention therefore yields reduced need for transportation and replacement of storage containers, as well as reduced volumetric requirements compared to the requirements linked to the currently used containers.

The thickness of the inter-space container part will be determined by type of radioactive material to be contained by the container. Highly radioactive material may over time have a tendency to deteriorate a plastic material, and in this context the inter-space container part serves not only to protect against radioactive radiation to the outside of the container, but also serves to protect the outer container part against deterioration over time due to radiation from the radioactive waste contained by the storage container. The inner container part 62 may not need to be thick-walled as the outer container part 69, but the outer container part will need to have walls that are sufficiently strong to also withstand stress caused upon lifting and handling of the heavy containers. In some cases handling of the containers may necessitate that straps can be attached around the container to lift and move it.

If the radioactive material to be contained is extremely radioactive or chemically aggressive, an inner liner inside the inner container part may be desirable, suitable made of a chemically inert material which provides some resistance to deterioration caused by radiation. However, in most cases the inner container part is made of a chemically inert and to the best possible extent also durable against radioactive radiation, above all to protect the inter-space layer. Apart from PEH/HDPE as possible materials for the inner container part and any possible extra inner liner, it could be considered using materials like concrete or ceramic materials. The outer container part is suitably made from a chemically inert material which inherently protects not only the inter-space container part, but also the inner container part and the nuclear waste against physical damage, while simultaneously preserving the integrity of the container over time to prevent escape of its contents. Although the sufficient overall physical strength of the storage container will primarily be contributed to by the outer container part and the lid structure fitted thereto, it is also conceivable to have the main strength of the container related to two or all three of the inner, the outer and the inter-space container parts.

It will be appreciated that if a twin mould apparatus as shown on FIG. 7 is used for casting the inner 62; 62' and outer 69 container parts, the apparatus must be large enough for casting both such parts.

However, it lies within the invention that both the inner container part 62; 62' and the outer container part 69 could each be made in a separate injection moulding apparatus instead of a common one as shown on FIG. 7. Thus, there could be either two moulding apparatuses with a dedicated mould in each for casting an inner and an outer container part, respectively, or a single moulding apparatus, as shown on FIG. 7 of a size capable of containing a replaceable mould for casting either the inner or the outer container part. In the latter case, it could be visualized to cast a specific number of inner container parts in a dedicated mould, then replacing that mould by one for making the outer container part, and thus using the pre-made inner container parts and inter-space container parts when making the outer container parts and thereby the final assembled container, as disclosed above.

In the practical, though not limitative embodiment of FIG. 7, the twin-cavity moulding apparatus is a currently preferred embodiment, thus enables casting of both the inner container part and outer container part in a single operation. Thereby, the need for another, separate moulding apparatus for casting the inner container part will be avoided.

As shown and disclosed above in connection with FIG. 7*a*, as a process start, only the inner container part is cast.

It will be appreciated by the expert in the art that the closure valve 64 is suitably associated with the injection channel 65 for the hot, melted plastic material to be injected, so that just the inner container part 62 is cast at the start of a production start, whereby the next mould cavity having the core 67 at that stage is inoperative as regards casting. This implies that at the end of the production cycle only the mould cavity for casting the outer container part is operative, whereas the mould cavity for casting an inner container part is inoperative as regards casting. Thus, between the production start stage and the production end stage of a production series, both the first and the next mould cavities in the moulding apparatus will be operative to receive injection of plastic material.

In view of the in particular the heavy weights of the container parts and above all the radioactive radiation inhibiting material related the container as well as the lid, it will be required to have available robots or other handling equipment to move the various parts in and out of the moulding apparatus. Thus, the completed, heavy storage container when removed from the moulding apparatus subsequent to the step of FIG. 7*d* and when the moulding apparatus is fully opened, will be removed through aid from the robot.

Further, a production plant will need to have required equipment related to moulding process, such as e.g. hydraulic or pneumatic units, basic moulding apparatus with pressure cylinders, valves etc. in addition to the mould or moulds, a supply of plastic material, any required grinder for such material, conveyors, material injectors, material heating equipment, as well as tools for maintenance, storage etc.

Furthermore, the casting of the lid part, including the radioactive radiation inhibiting material therein, will have to be made in a moulding apparatus which is preferably separate from that making the inner and outer container parts, in order not to complicate operations.

The lid, suitably made from the same plastic material, will also comprise a nuclear radiation barrier made from lead material.

The invention claimed is:

1. A method for manufacturing a long-term storage container for storage of radioactive material to inhibit radioactive radiation therefrom to the outside of the container, said container having a bottom and upright wall extending therefrom, the top of said container to be closed off by a screw-on lid, said container having an integral inner container part of a first material with a bottom and upright wall, an integral outer container part of a second material with a bottom and upright wall, and radioactive radiation inhibiting material in an inter-space between the walls and bottoms of said inner and outer container parts; the method comprising:

integrally casting in a first mould through injection moulding a first container part having a bottom and a wall, removing the first container part from the first mould;

integrally casting in a second and separately located mould through injection or pressure moulding an inter-space container part of said radioactive radiation inhibiting material, said inter-space container part having a bottom and a wall and forming a second container part, removing said interspace container part from the second mould, placing the first container part in a third mould, placing said inter-space container in fitting engagement with exterior face of the first container part to form a first assembly of container parts, in the third mould locating the first assembly of container parts to cause said inter-space container part to be in spaced relationship to a mould member of the third mould, so as to form a cavity between the mould member of the third mould and the outside of the inter-space container part, the inside of the first container part being fitted onto a core member of the third mould, through injection moulding into said cavity integrally casting the outer container part forming a third container part having a side wall and a bottom, said third container part engaging the exterior faces of the inter-space container part, and removing from the third mould a second assembly of container parts formed by the first, second and third container parts to provide said storage container.

2. A method according to claim 1, wherein a further first container part is cast simultaneously with the casting of the third container part.

3. A method according to claim 1, wherein said first and second materials are high density polyethylene materials.

4. A method according to claim 1 wherein said inter-space container part forming the second container part is moulded from a radioactive radiation inhibiting material which is selectable from one of: lead, lead alloy, tin and tin alloy.

5. A method according to claim 1 wherein the casting of the third container part in addition provides for threads on the outside of said outer container part, said threads dimensioned to enable fitting engagement with threads on a lid to be fitted by screwing onto the storage container.

6. A method according to claim 5, wherein the provision of threads on the outer container part also includes provision of locking means configured for non-releasable engagement with a locking member on said lid when said lid is fully screwed onto the storage container.

7. A method for manufacturing a long-term storage container for storage of radioactive material to inhibit radioactive radiation therefrom, said container having a bottom and upright wall extending therefrom to the outside of the container, the top of said container to be closed off by a screw-on lid, said container having an integral inner container part of a first material with a bottom and upright wall, an integral outer container part of a second material with a bottom and upright wall, and radioactive radiation inhibiting material in an inter-space between the walls and bottoms of said inner and outer container parts; the method comprising:

integrally casting in a first mould through injection moulding a first container part having a bottom and a wall, integrally casting in a second and separately located mould through injection or pressure moulding an inter-space container part of said radioactive radiation inhibiting material, said inter-space container part having a bottom and a wall and forming a second container part, and removing said inter-space container part from the second mould, separating the first container part from a first part of the first mould which formed exterior side wall and bottom faces of the first integral container part, providing the first mould with a second part having a third mould placing said inter-space container in fitting engagement with said exterior faces of the first container part to form a first assembly of container parts, the first container part being in engagement with a portion of the second part of the first mould;

locating in the third mould the first assembly of container parts and causing said inter-space container part to be in spaced relationship to a mould member of the third mould, so as to form a cavity between the mould member of the third mould and the outside of the inter-space container part, the second part of the first mould having a portion inside the first container part to support it during moulding in the third mould, and a top of the second part of the first mould configured to be used to close off an open end of said mould member of the third mould, through injection moulding into said cavity integrally casting a third container part having a side wall and a bottom, and removing from the third mould a second assembly of container parts formed by the first, second and third container parts to provide said storage container.

8. A method according to claim 7, wherein said first and second materials are elected from the group of-high density polyethylene and ceramic materials.

9. A method according to claim 7, wherein said inter-space container part forming the second container part is moulded from a radioactive radiation inhibiting material which is selectable from one of: lead, lead alloy, tin and tin alloy.

10. A method according to claim 7, wherein the casting of the third container part in addition provides for threads on the outside of said outer container part, said threads dimensioned to enable fitting engagement with threads on a lid to be fitted by screwing onto the storage container.

11. A method according to claim 10, wherein the provision of threads on the outer container part also includes provision of locking means configured for non-releasable engagement with a locking member on said lid when said lid is fully screwed onto the storage container.

12. A method for manufacturing a radioactive radiation inhibiting lid suitable for fitting onto a top region of a storage container for long term storage of radioactive material and inhibiting radioactive radiation therefrom to the outside of the lid, the method comprising:

providing a pre-cast second lid member made from radioactive radiation inhibiting material, suitably selected from lead, lead alloy, tin and tin alloy, placing the second lid member in a mould for moulding around at least one face and the edges thereof a first and integral lid member through injection moulding of a first material, said integral first lid member provided with a top part and a skirt depending therefrom, said casting providing on an inside of said skirt threads to enable fitting engagement with external threads on said storage container, said first lid member further providing in said top part at least one recess in which said second lid member is located, and removing from the first mould said first lid member with the second lid member in non-releasable engagement with the first lid member.

13. A method according to claim 12, wherein said first mould is configured to provide at a lower end of the skirt a lifting or engagement face suitable to cooperate with a container lifting device when such device is made to engage a container having a fitted lid.

14. A method according to claim 12, wherein said step of casting said threads includes providing a locking member for non-releasable engagement with locking means on the outside of the storage container when the lid is fully screwed onto the storage container.

15. A method according to claim 12, wherein said first material is high density polyethylene.

16. A method according to claim 12, wherein said radioactive radiation inhibiting material is selected from lead, lead alloy, tin and tin alloy.

17. A moulding apparatus for casting inner and outer container parts of a long-term storage container for storage of radioactive material to inhibit radioactive radiation therefrom to the outside of the container, the storage container to be provided with a radioactive radiation inhibiting material in an inter-space between said inner and outer container parts, wherein said apparatus comprises two separate moulds:

a primary mould having a mould cavity for casting an inner container part having an integral bottom wall and upright wall, and a secondary mould having a mould cavity for casting an outer container part having an integral bottom wall and upright wall, said secondary mould having a member for supporting the inner container part with a separately provided inter-space container part fitted thereon when casting the outer container part such that the outer container part engages the outside face of the inter-space container part.

18. A moulding apparatus according to claim 17, wherein the apparatus is provided with means for operating both the primary mould and the secondary mould simultaneously.

* * * * *